US009839312B1

(12) United States Patent
Carter

(10) Patent No.: US 9,839,312 B1
(45) Date of Patent: Dec. 12, 2017

(54) ARTICLE FOR THE SUPPORT AND DISPLAY OF WEDDING VEILS AND ACCESSORIES

(71) Applicant: Martha L Carter, Arlington, TX (US)

(72) Inventor: Martha L Carter, Arlington, TX (US)

( * ) Notice: Subject to any disclaimer, the term of this patent is extended or adjusted under 35 U.S.C. 154(b) by 0 days.

(21) Appl. No.: 15/004,895

(22) Filed: Jan. 23, 2016

(51) Int. Cl.
*A47G 25/10* (2006.01)
*A47G 25/28* (2006.01)
*A47G 25/32* (2006.01)

(52) U.S. Cl.
CPC ..... *A47G 25/10* (2013.01); *A47G 25/28* (2013.01); *A47G 25/32* (2013.01)

(58) Field of Classification Search
CPC ..... A47G 25/10; A47G 2025/1492; A47G 2025/20; A47G 2025/28; A47G 2025/34; A47G 2025/36; A47G 2025/4007; A47G 25/32
See application file for complete search history.

(56) References Cited

U.S. PATENT DOCUMENTS 503,949 A * 8/1893 Crouch ..... A47G 25/10 211/32
781,369 A * 1/1905 Scott ..... A47G 25/10 211/31
1,069,893 A * 8/1913 Mendelson ..... A47G 25/10 211/32
1,370,105 A * 3/1921 Fuld ..... A47F 7/00 211/126.16
1,698,633 A * 1/1929 Jimenez ..... A47G 25/10 211/33
2,471,007 A * 5/1949 Pasznicki ..... A47G 25/20 211/32
5,509,588 A * 4/1996 Kimball ..... A47G 25/54 206/286
D625,583 S * 10/2010 Benson ..... D8/367
9,301,565 B1 * 4/2016 Mondrella ..... A42B 1/08

* cited by examiner

*Primary Examiner* — Ismael Izaguirre
(74) *Attorney, Agent, or Firm* — Richard G. Eldredge; Eldredge Law Firm

(57) ABSTRACT

A wedding veil support and display for the transport and display of wedding veils and accessories includes a display body adapted to fit under a veil, maintain the shape of the veil when transporting the veil, and, in cases where the display body is suspended from a clothing rod or peg, support the veil in an upright position such that the veil and any displayed accessories such as jewelry, may be viewed or photographed in a natural state, e.g., the manner in which the veil is intended to be worn, adjacent a bridal gown.

10 Claims, 12 Drawing Sheets

ARTICLE FOR THE SUPPORT AND DISPLAY OF WEDDING VEILS AND ACCESSORIES

FIELD OF THE INVENTION

The invention relates generally to apparel displays, and more particularly displays for wedding veils, and wedding veil accessories for storage and merchandising display purposes.

BACKGROUND

Veils, worn since ancient times, were designed for both practical considerations, e.g., to afford women a degree of anonymity, and to be symbolic. In Jewish and Christian wedding ceremonies, the veil symbolizes the transition of the bride from an unmarried to a married state when the veil is lifted either by the bride's father, a proxy such as another significant member of the family, or by the groom. While the particular habits of wearing the veil vary by culture, wedding veils come in a variety of transparencies, shapes, lengths and trim. Commonly, a wedding veil has an inside upper portion attachable to the hair of the bride which may include a hair comb, clip, or other means of affixment to the hair, and a trailing portion which may include a decorative trim, e.g., lace, chosen to match the bridal gown. A fascinator is an accessory often worn with a veil that may include beads, flowers or other decorative elements as an accent piece.

For many years and up to the present time, merchandisers of bridal apparel have typically employed a type of veil hanger that includes a hook and a clip attachable to the veil such that the veil is displayed in an inverted state. While such a veil hanger is compact, it is difficult for the shopper or sales staff to visualize what the veil will look like when mixed and matched with different gowns when the veil is displayed inverted.

It would be desirable to provide a space economizing veil display and support article for displaying wedding veils in an upright position.

It would be additionally desirable to provide a veil display and support that prevents the veil from being crumpled and creased during transport, either when boxed shipped, or hanging transport by vehicle.

It would be furthermore desirable to accommodate the custom of taking professional photographs of wedding gowns by providing a veil display article that displays a paired veil in a natural state; e.g., upright as it is intended to be worn, next to the wedding gown, and with any jewelry intended to be worn displayed with the veil display article. In cases where the wedding gown and veil are to be photographed, the veil display article with the veil may be hung from a wall mounted peg superior to the wedding gown, such that the back side of the veil is displayed against the wall.

It would be still further desirable to provide a pocket or recess within a veil display article that would permit the bride the convenience of transporting her veil and jewelry together the event setting the day of the wedding.

SUMMARY OF THE INVENTION

The present invention includes a space economizing wedding veil support and display that may be packaged with a wedding veil and employed in merchandising to optimally display a wedding veil in a natural, i.e., upright position, so that the appearance of a paired gown and veil may be quickly appreciated and evaluated.

A general embodiment of the invention includes a display body with a rounded portion adapted to fit under a wedding veil with or without a head piece, and configured to hang from a clothing rod, post or peg.

In a first aspect of the invention, a substantially planar side of the display body is adapted to rest stably against a flat surface without rocking from side to side when the veil is displayed.

In a second aspect of the invention combinable with any other aspect, the display body includes a hook adapted to hang from a rod or post.

In a third aspect of the invention combinable with any other aspect, the display body may include a section of a spherical body adapted for placement under the veil or head piece.

In a fourth aspect of the invention combinable with any other aspect, the display body may include a section that is a one half section of a sphere adapted for placement under the veil or head piece.

In a fifth aspect combinable with any other aspect, the display body may include a section that is a one quarter section of a sphere adapted for placement under the veil or head piece.

In a sixth aspect combinable with any other aspect, the display body may include an open recess or reversibly sealable compartment for storing bridal accessories and other small items.

In a seventh aspect combinable with any other aspect, the display body may include a substantially planar bottom side for resting on a flat surface such as a countertop.

In an eighth aspect combinable with any other aspect, the display body may include a soft exterior that may be penetrated by hat pins and the like.

In a ninth aspect combinable with any other aspect, the display body may include a tether with snaps or other fastening members, in place of a swivelable hook for suspension from a clothing rod, a post, a knob or the like.

In a tenth aspect combinable with any other aspect, the display body may include a hook that hinges, folds or pivots toward the display body for storing or shipping purposes.

In an eleventh aspect combinable with any other aspect, the display body may include a covering selected to match the fabric of a particular bridal gown.

In a twelfth aspect combinable with any other aspect, the display body may include a removable and/or replaceable covering.

In a thirteenth aspect combinable with any other aspect, the display body may include a padding or batting covered with a solid fabric with a lace fabric overlay.

In a fourteenth aspect combinable with any other aspect, the display body may include a pocket with or without a closure flap, an elastic gather about the pocket opening, or a zip fastener to store jewelry and other small items.

In various embodiments, an open or sealable compartment of the hanging body may be sub-compartmentalized.

In various embodiments, an open or sealable compartment of the hanging body may be lined with for example, a soft material or lacking a lining.

BRIEF DESCRIPTION OF THE DRAWING FIGURES

Figure 1:
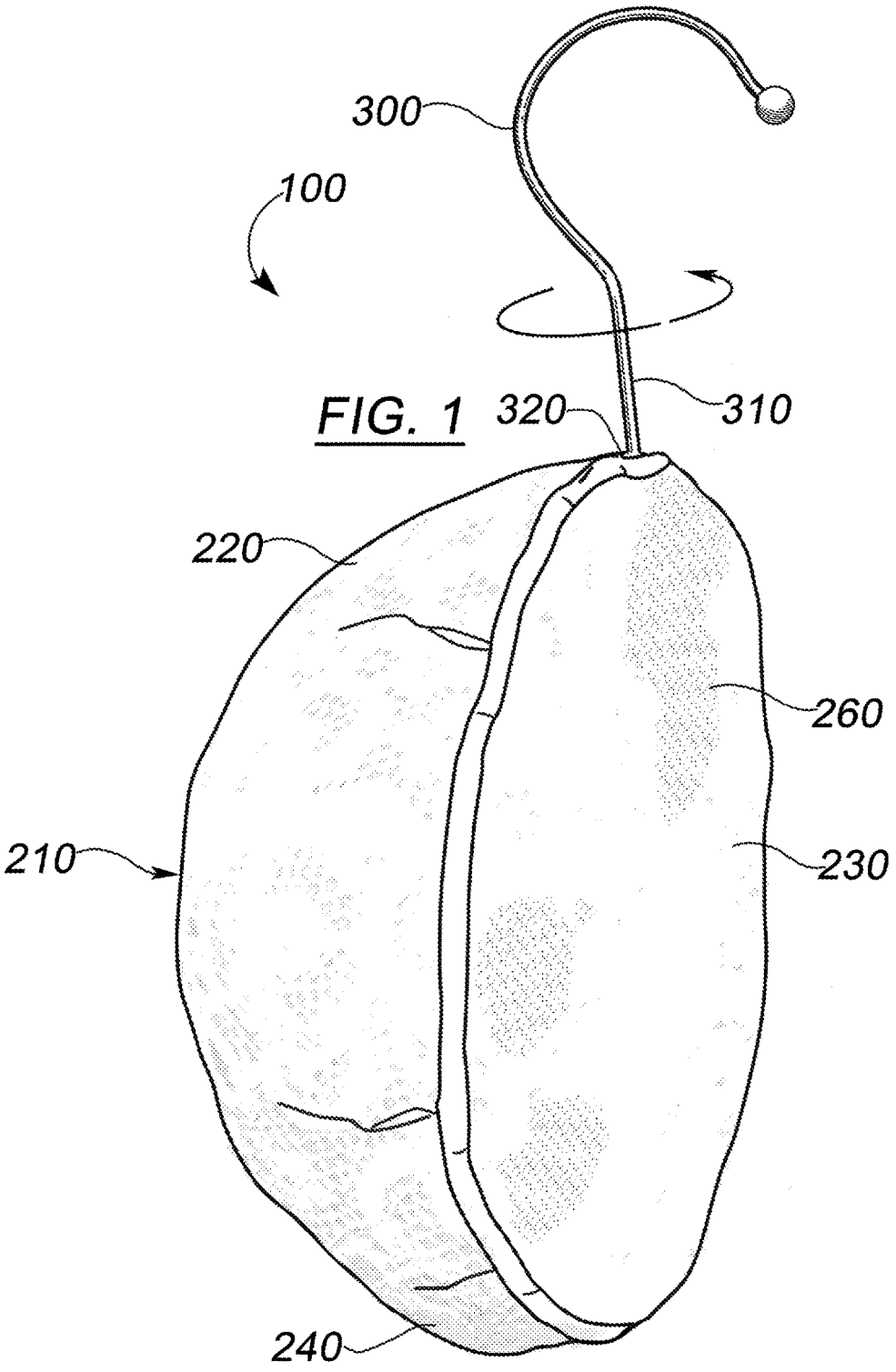
FIG. 1 is a perspective view of one embodiment of the display article.
Figure 2:
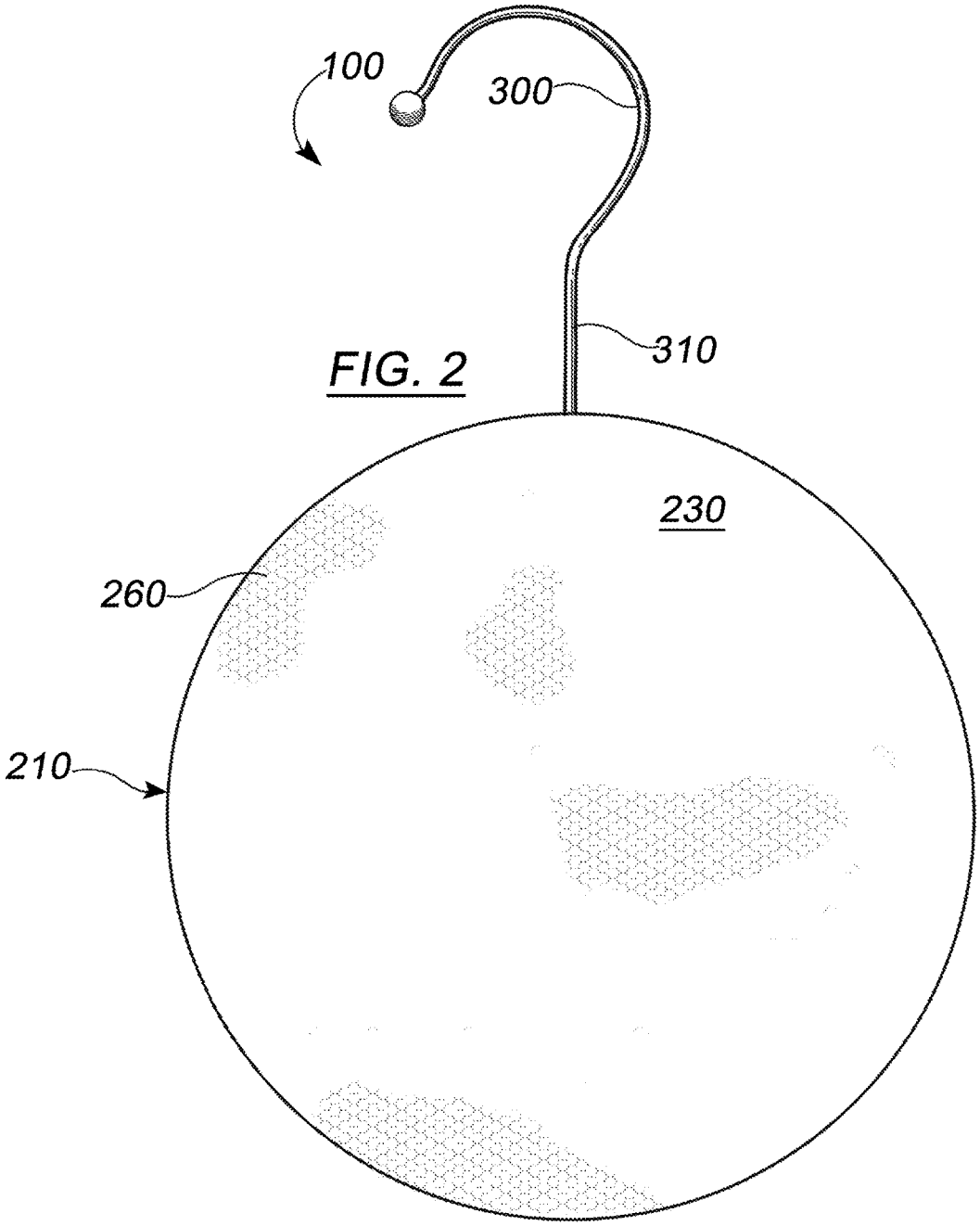
FIG. 2 is a back plan view thereof.
Figure 3:
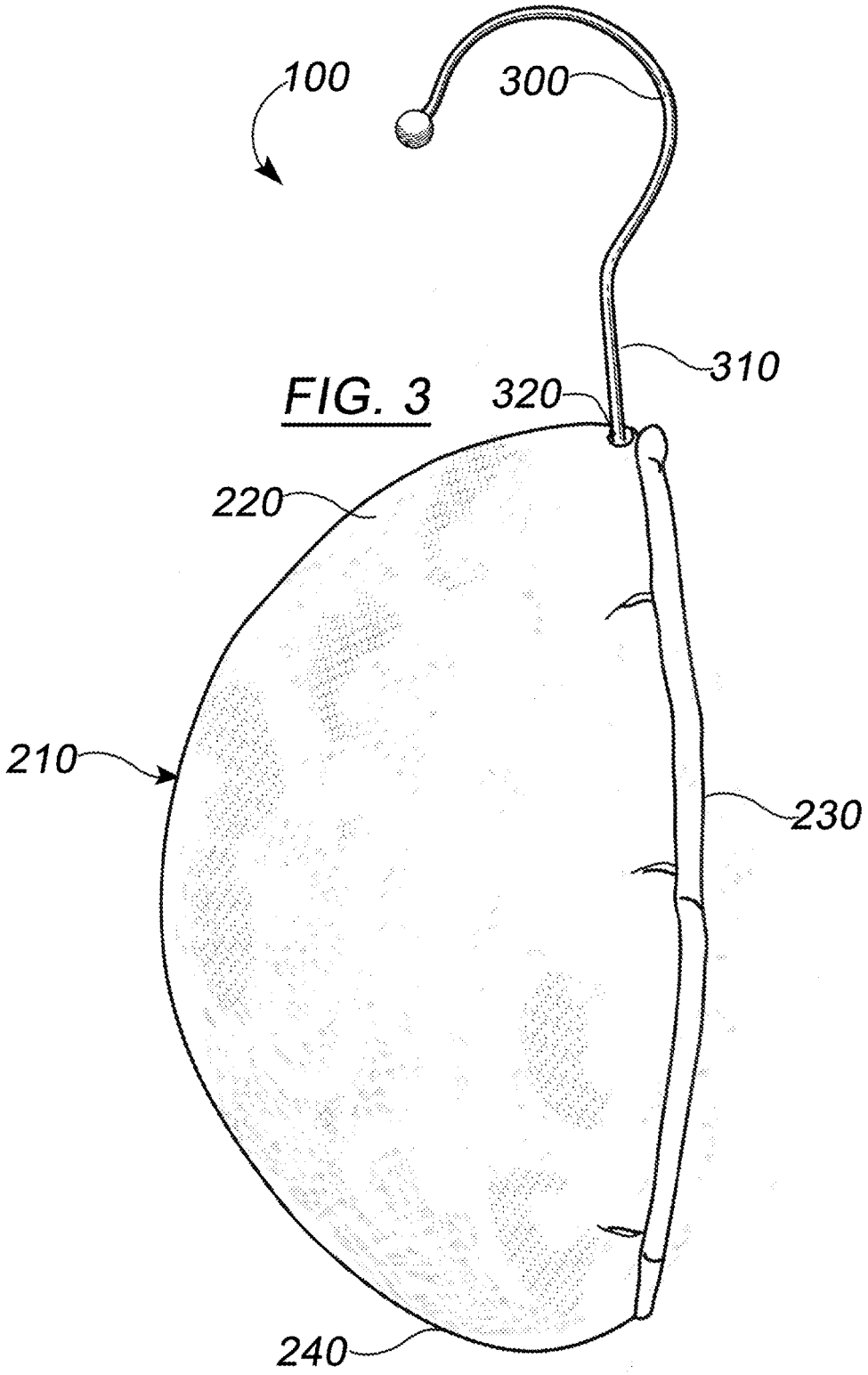
FIG. 3 is side elevation view thereof.
Figure 4:
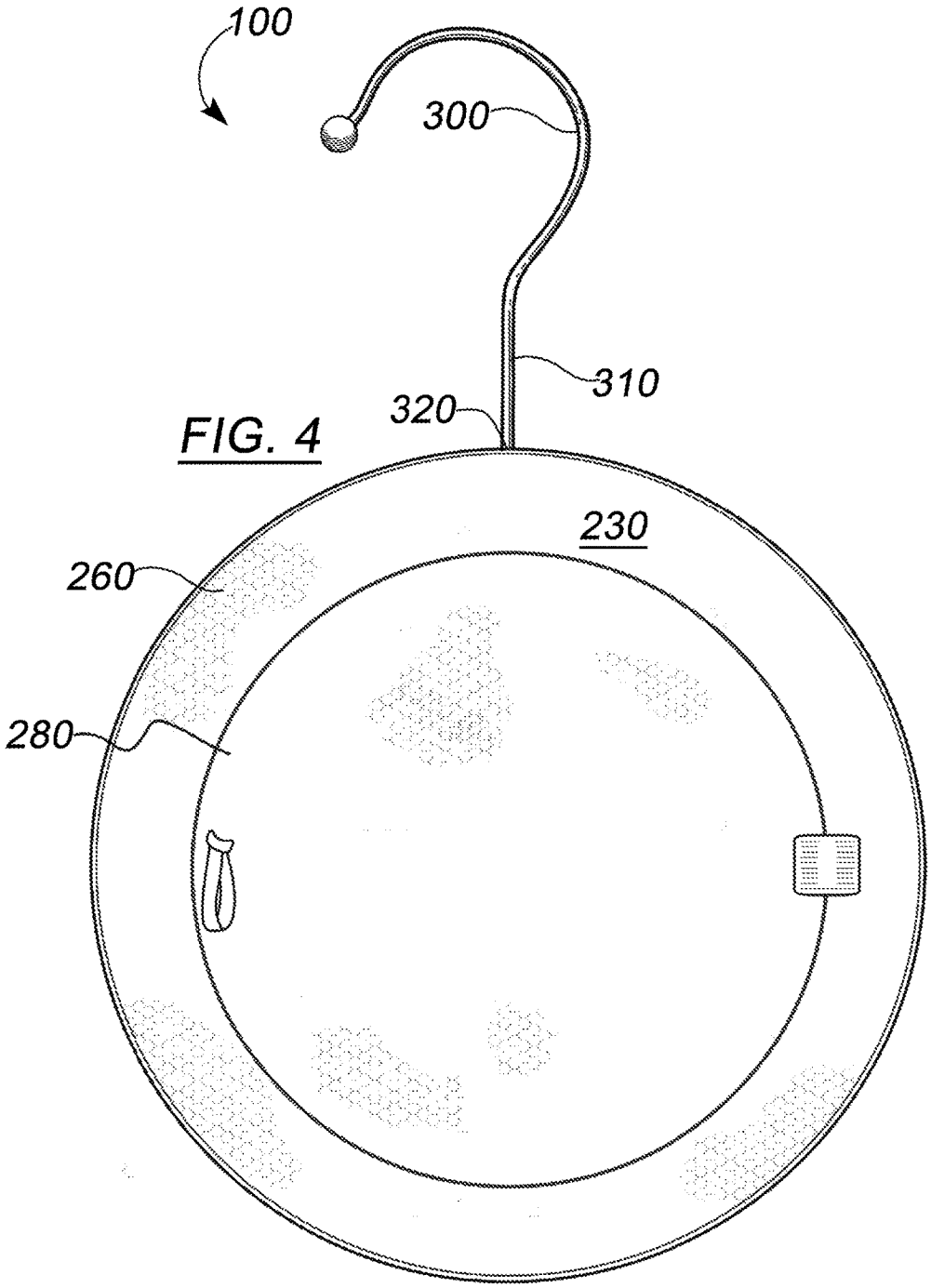
FIG. 4 is a back plan view thereof showing access panel 280.
Figure 5A:
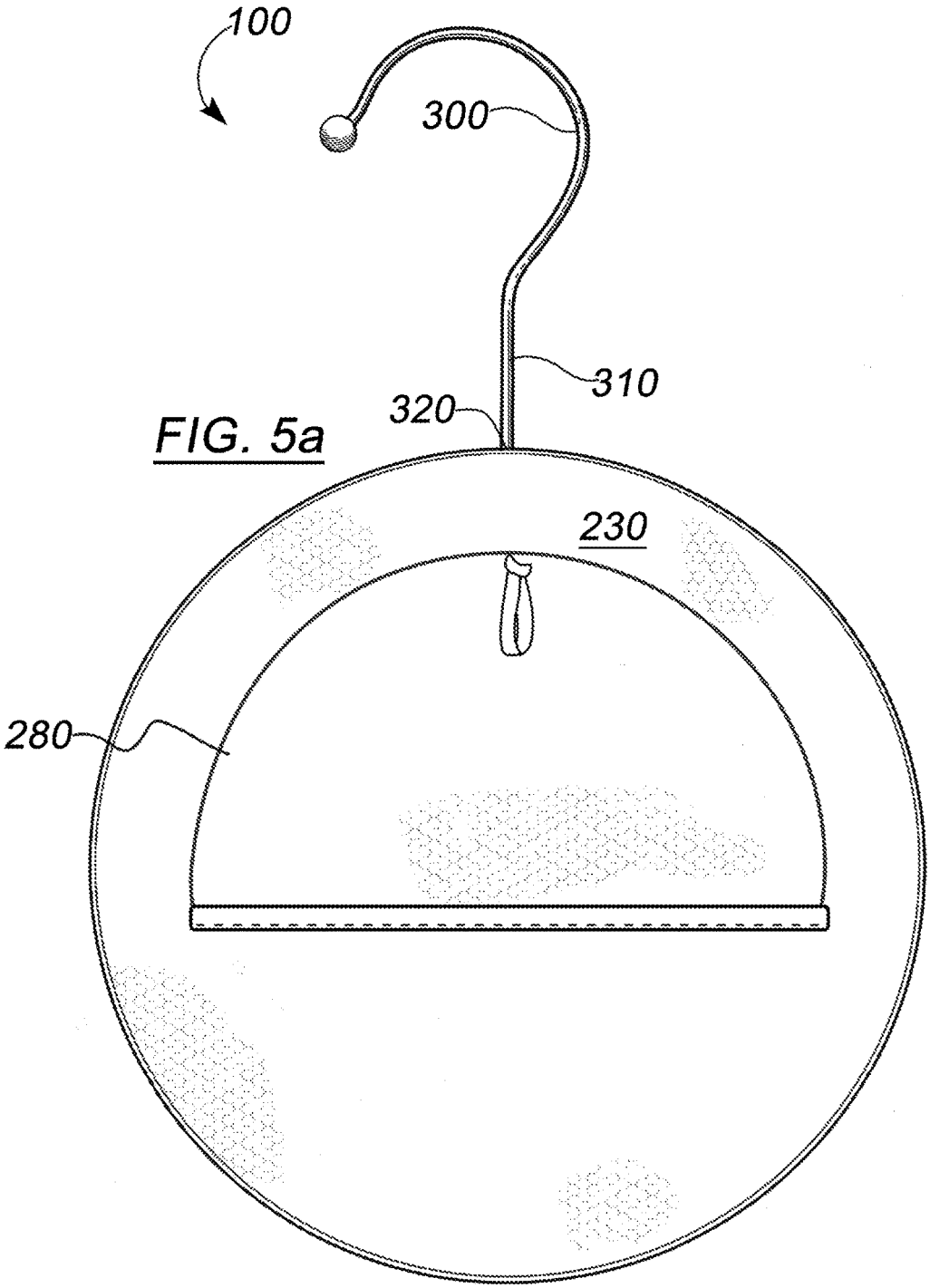
Figure 5B:
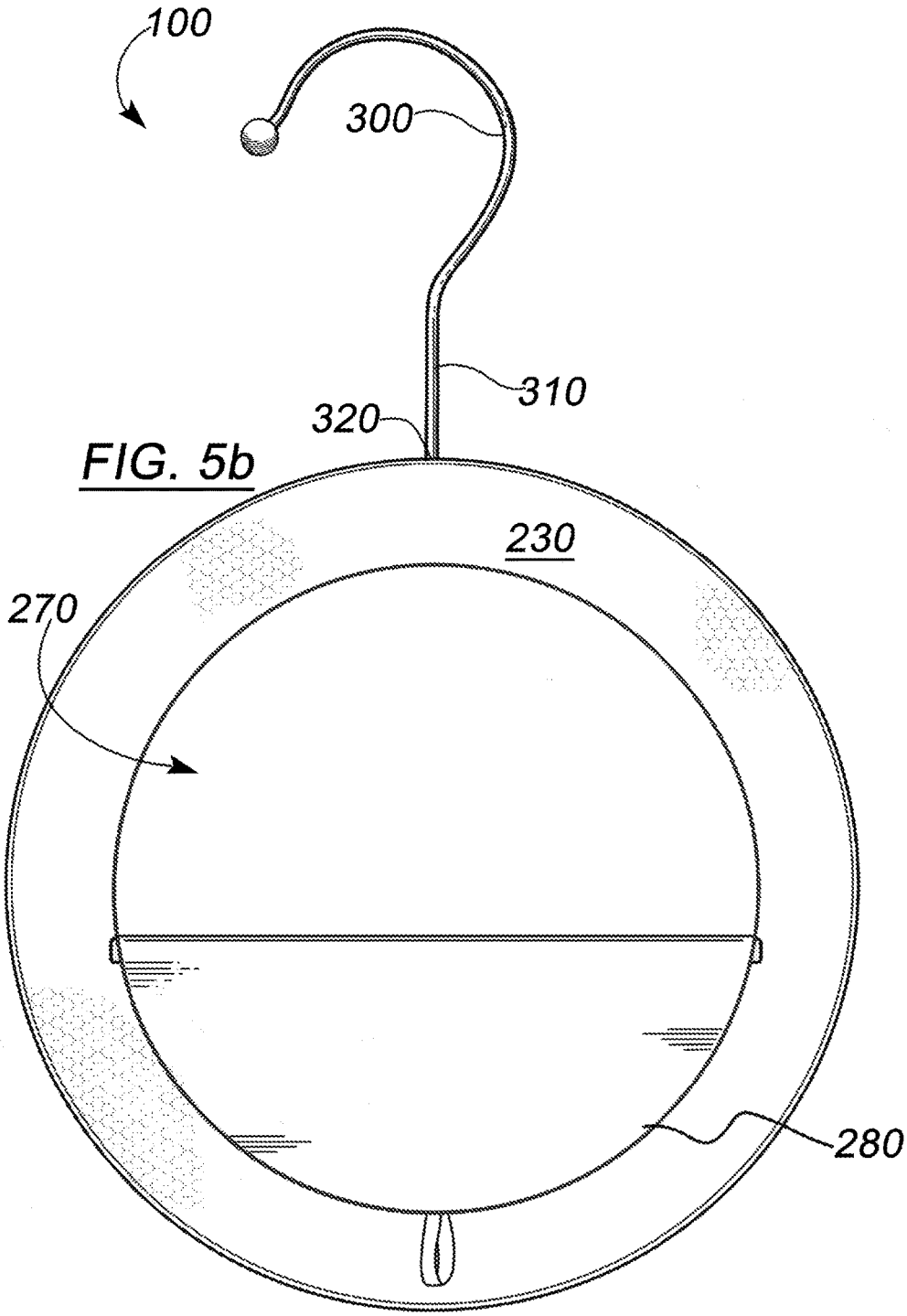
Figure 5C:
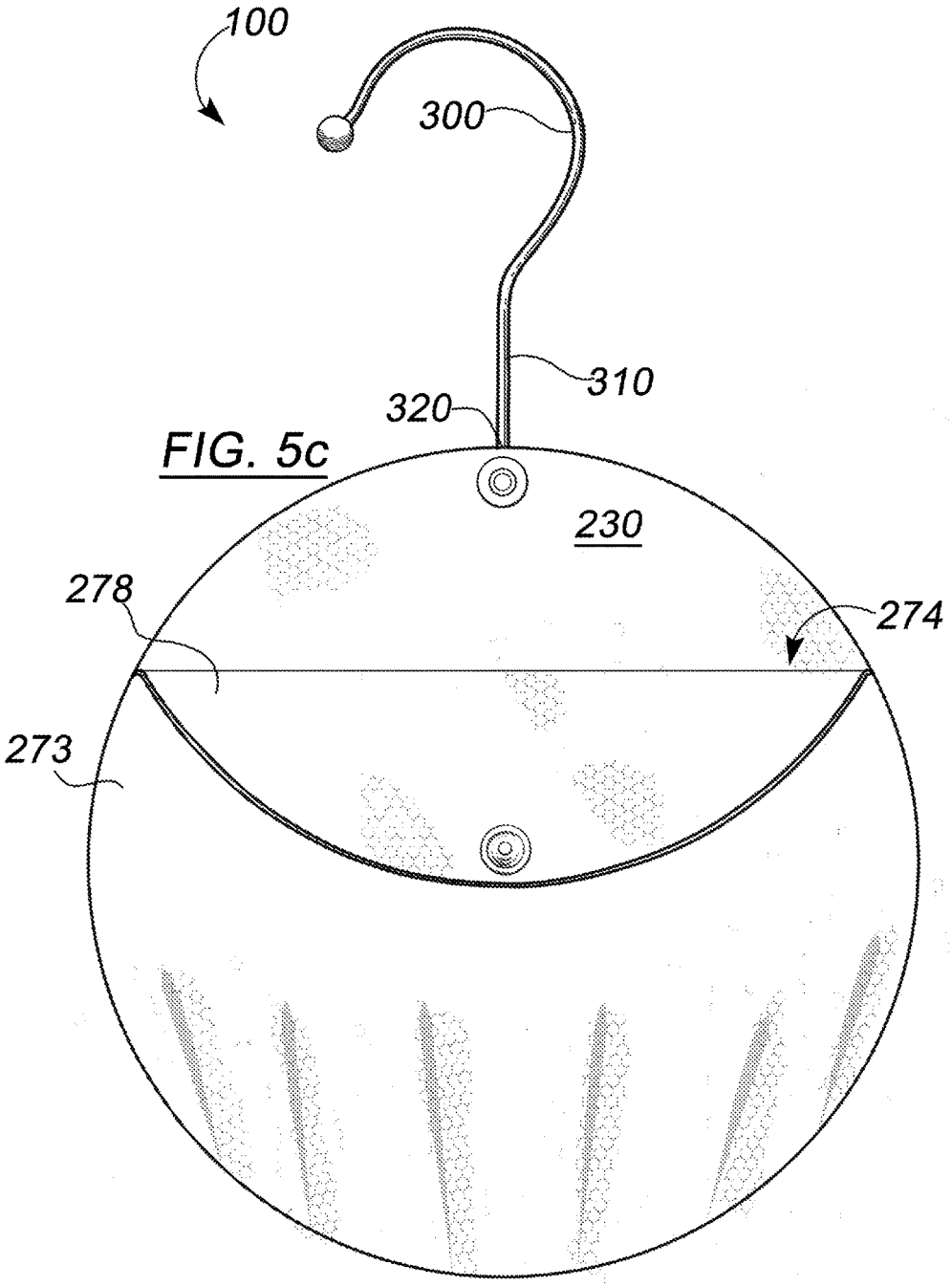
Figure 5D:
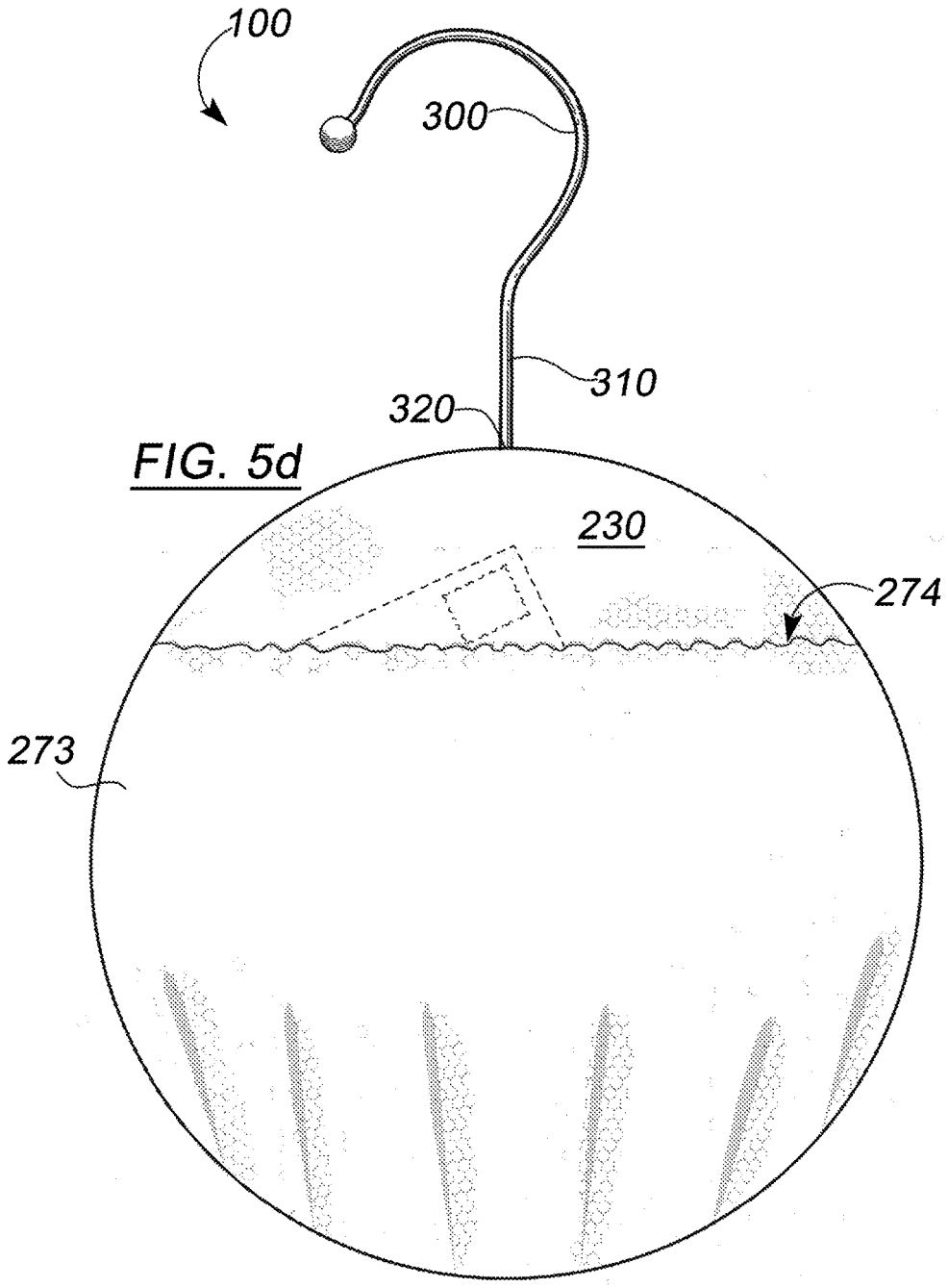
Figure 6:
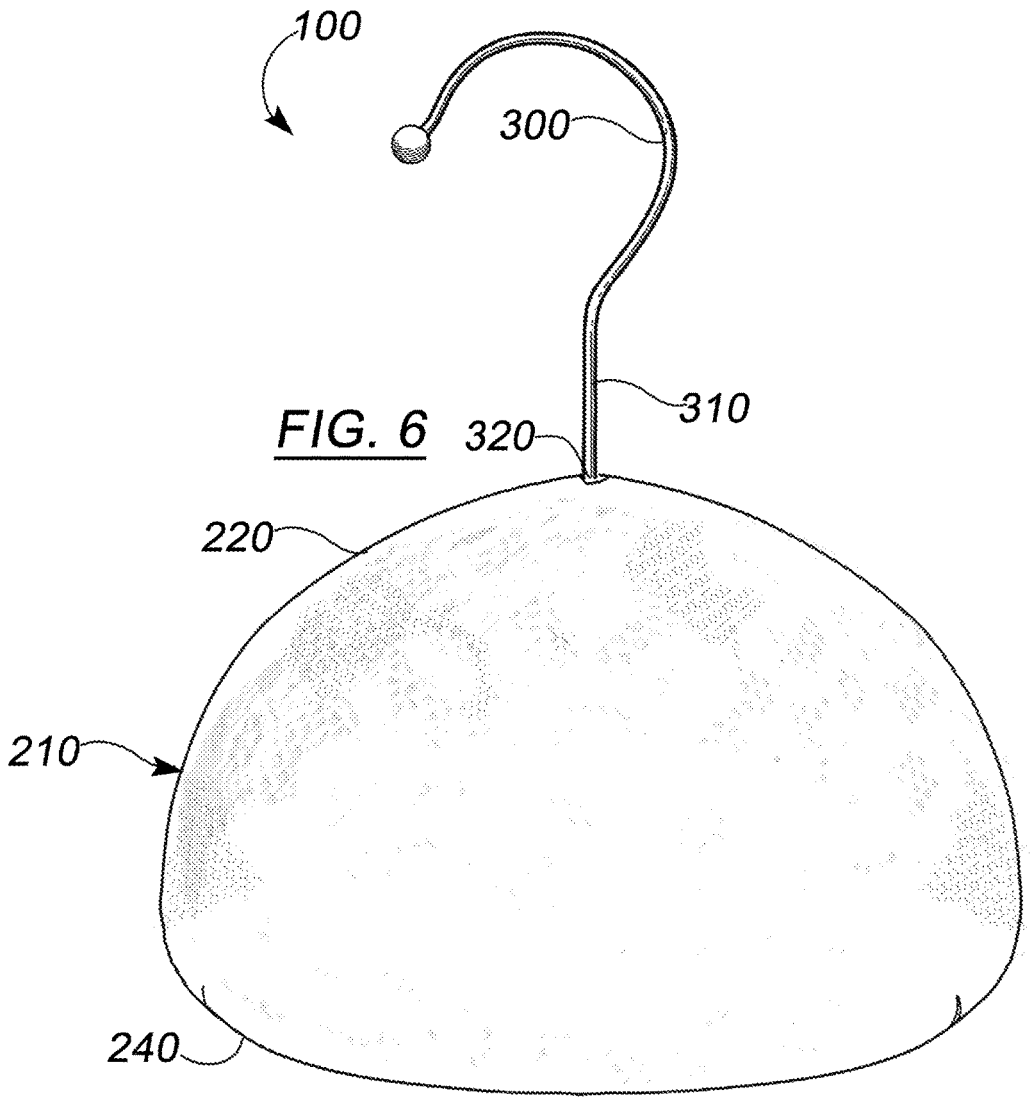
Figure 7:
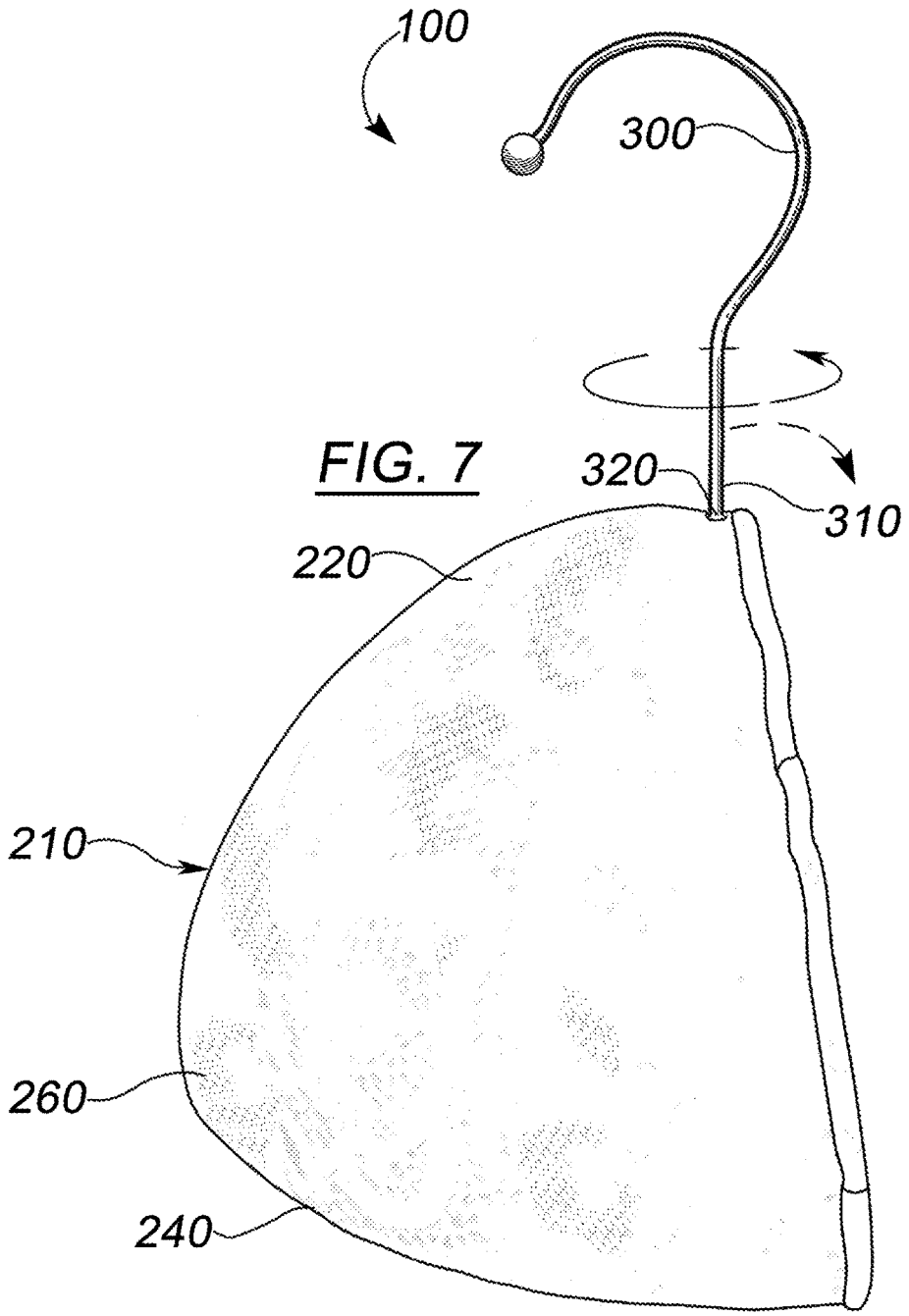
Figure 8:
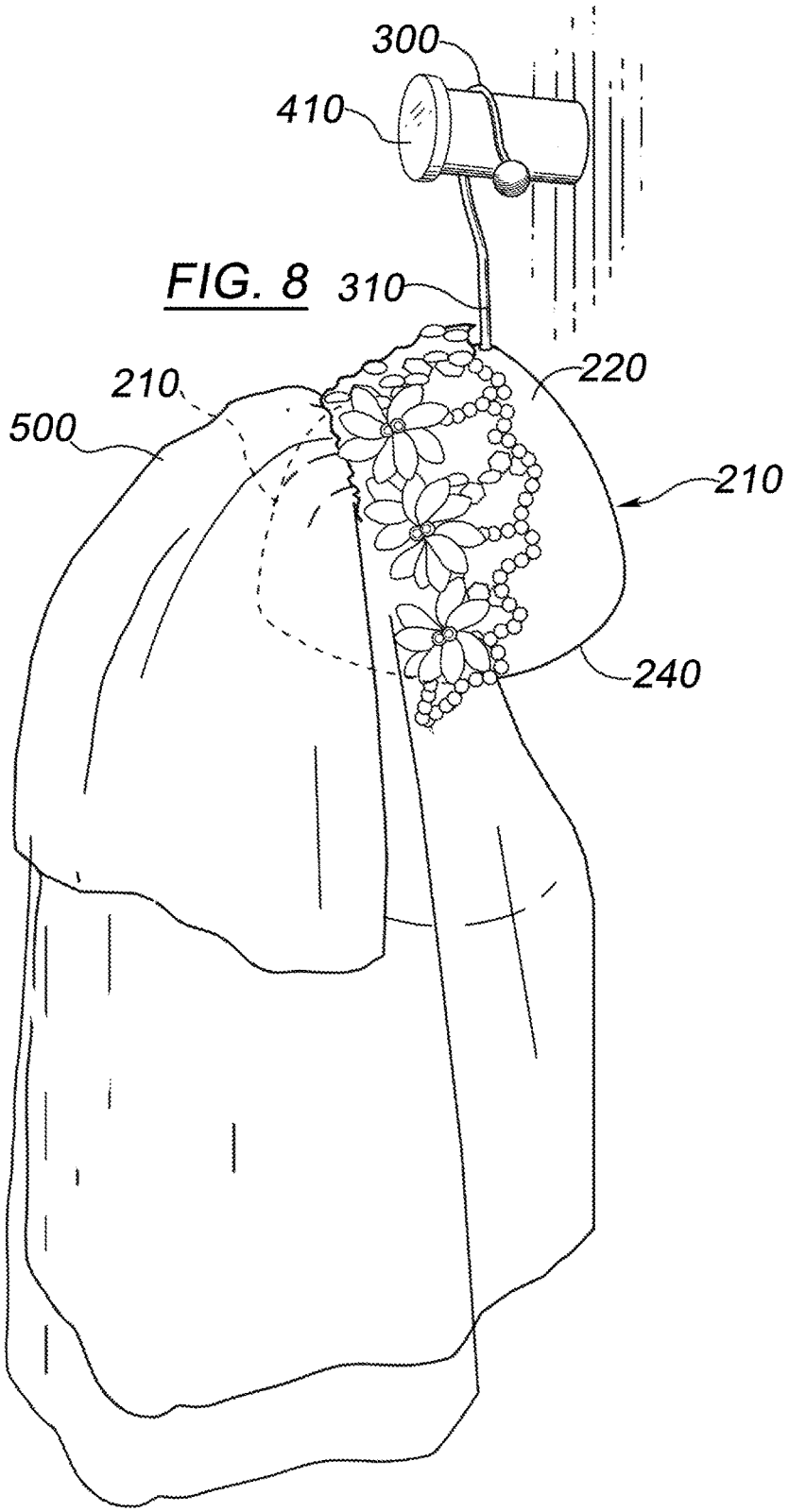
Figure 9:
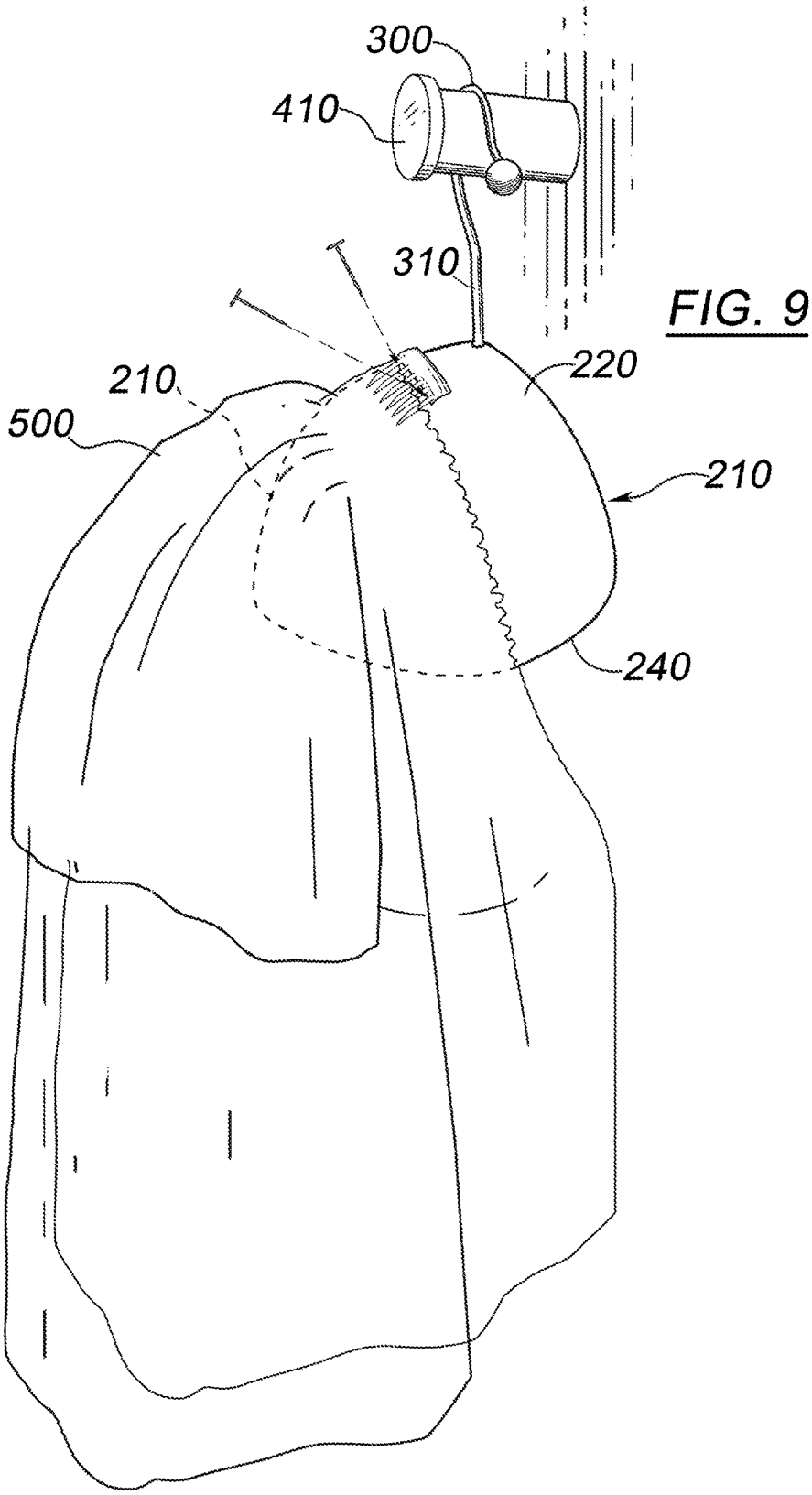

FIGS. 5*a* and 5*b* are respectively back plan views showing access panel 280 closed and opened, revealing compartment 270;

FIGS. 5*c* and 5*d* show respectively a display article with a pocket 274 with flap 278, and a pocket with a gathered elastic opening;

FIG. 6 is a perspective view of a second embodiment thereof;

FIG. 7 is a side elevation thereof;

FIG. 8 is a perspective view illustrating a typical use of the display article when suspended from a peg;

FIG. 9 is another perspective view illustrating a typical use of the display article when suspended from a peg;

DETAILED DESCRIPTION OF THE EMBODIMENTS

Reference Listing of the Named Elements

100 display article
210 article body
220 body upper portion
230 body back portion
240 body lower portion
250 body core
260 covering
270 compartment
273 material layer
274 pocket
278 pocket flap
280 access panel
290 panel latch
300 hook
310 post
320 swivel member
330 pivot
400 clothing rod
410 peg
500 veil

Definitions

Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein, if any, are incorporated by reference in their entirety for all purposes. In case of conflict, the present specification, including explanations of terms, will control. In addition, the materials, methods, and examples are illustrative only and not intended to be limiting.

Referring generally to FIGS. 1-9, a storage and display article 100 for the transporting and display of wedding veils and accessories includes a article body 210 adapted to fit under a veil 500 so as to support the veil in an upright, i.e., non-inverted position, in order that the veil may be photographed, displayed by a retailer, and/or assessed by a consumer in a natural disposition adjacent a wedding gown. The article body 210 includes an upper portion 220 that is typically arched, a back portion 230 that includes a planar section that may extend over the entire face of the back portion, or only a limited area of the back portion 230, but in any case, such that the back portion is adapted to rest stably, e.g., with rocking back and forth, against a flat surface such as a table top or wall. The article body 210 also includes a lower portion 240 which may mirror the upper portion in shape, or be truncated. The outer contours of the display body may resemble a half section of a sphere or a transitional shape between a half section of sphere and a quarter section of a sphere.

Article body 210 may include a body core 250 of lightweight material such as closed cell foam, open cell foam or styrofoam having a molded exterior texture suitable for display, or, the underlying body core of lightweight material may include a covering 260 of decorative material that is glued, sewn to, or otherwise affixed to the body core. The article body may be penetrable by t-pins or other fasteners to affix a portion of a veil, such as a hair comb, to the display body. The article body may include ties, sewn loops, button holes, hook and loop fasteners or other means for securing a veil or head piece thereto as would be appreciated by those having skill in the art and benefit of the disclosure.

Article body 210 may include a hook 300 adapted to hang over a clothing rod, post or peg. Hook 300 may be in a fixed position for hanging on a clothing rod, or swivel so that the veil may be turned to face out from a clothing rod. Typically hook 300 includes a post 310 that is engaged with the upper portion of the display body via a swivel member 320, which may be any coupling permitting the post to swivel which is molded into or added to the article body at any stage of manufacture.

In various embodiments of the present invention, a display body 210 may incorporate a cavity, a recess or a compartment 270 sized and shaped to store wedding veil accessories, such as pins, hair clips or other small articles for use with the veil. In various embodiments, a compartment 270 may have an access panel 280 situated on the back side 230 of the display body. Access panel 280 may pivot away from an opening 282 to the compartment 270 or it may be removable, e.g., an insert, or plug. Access panel 280 may be unsecured except for a friction fit between the panel sides and the back side of the display body, or secured by hook and loop fasteners, a button and loop, a clasp, a magnet, a snap closure or other customary means that would suggest themselves to those having skill in the art. In addition to practical considerations for storage and packaging purposes, it is contemplated that such a compartment may provide a means for family and friends to convey surprise gifts or notes of best wishes to the bride.

FIGS. 1-5*b* depict a veil display and support with a display body 210 having a shape resembling that of a half sphere. The rounded portion of display body 210 is adapted to fit under the crest of a veil, where it is typically affixed to the hair comb portion of the veil. Display body 210 can be solid, or possess a compartment (FIG. 5) accessible from the back portion of the body. The display body may be covered with satin or lace as shown, or other material as desired. Hook 300 may be a metal hook as shown, a molded plastic hook, or a flexible strap that forms a hook or loop which may be placed over a clothing rod, post or peg. Hook 300 may be fixed in place or may swivel about axis of post 310. Hook 300 may be configured to pivot or fold against body 210.

FIGS. 5*c* and 5*d* depict respectively, a pocketed 274 construction at the back of the display body with and without a pocket flap 278. While the embodiment depicted in FIG. 5*c* shows snap fasteners for securing the pocket flap, any suitable fastener may be employed.

FIGS. 6-9 depict a veil display and support with a display body 210 having a shape resembling that of a quarter sphere that otherwise shares elements of the embodiment shown in (FIGS. 1-5*b*).

The following steps outline merely one exemplary method of manufacture that can be employed to produce the veil display and support article of the invention: Molding a foam body in the form of a half section of a sphere or quarter section of a sphere with a substantially planar side opposite that of the rounded portion of the section of a sphere; covering the foam body with a batting and decorative fabric; and installing a hook adapted to swivel to an upper portion of the body. It should be understood that excepting the production of the foam body, the particular steps outlined above may be performed in any order.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. An article for transport, display and merchandising of a wedding veil comprising:

(1) a hook member with a lower portion including a swivelable connection, the hook member having a curved upper portion configured to hang from a horizontally disposed rod or post and a lower portion having a vertical axis;

(2) a body connected directly to the lower portion of the hook member at an apex of the body, the body adapted to display the wedding veil in a right side up position when the body is suspended from the hook member, the body including: a bordered first side taking the shape of a section of a sphere and configured to fit under the veil, a bottom side, and, a second side opposite the first side and sharing a border therewith, having a substantially planar surface configured for stably resting against a flat surface in a horizontal position, or vertical position when suspended by the hook member.

2. The article for display according to claim 1, wherein the section of a sphere is a one quarter or one-half section of a sphere.

3. The article for display according to claim 1, wherein the hook member is configured to swivel.

4. The article for display according to claim 1, wherein the body further comprises a storage compartment on the second side.

5. The article for display according to claim 1, wherein the hook member is configured to pivot toward the body for shipping purposes.

6. The article for display according to claim 1, wherein the body further comprises a storage recess with an access panel in the second side.

7. The article for display according to claim 1, wherein the body further comprises a fabric covering.

8. A method of manufacture for an article for the transport of wedding veils and the merchandising display thereof comprising the steps of:

providing a body core including a curving portion having the shape of a section of a sphere configured to fit under the veil, the body core further includes a bottom portion, a substantially planar back side opposite the curving portion adapted to rest stably against a flat surface, and an uppermost portion, and a storage compartment;

attaching a hanger member directly to the uppermost portion of the body core;

covering the body core with a decorative fabric material penetrable by t-pins.

9. The method according to claim 8 wherein the body core is penetrable by hat pins.

10. The method according to claim 8 wherein the hanger member has a post portion configured to pivot or swivel.

* * * * *